US010711498B2

(12) United States Patent
Grewe et al.

(10) Patent No.: US 10,711,498 B2
(45) Date of Patent: Jul. 14, 2020

(54) DOOR CLOSER

(71) Applicant: Kason Industries, Inc., Newnan, GA (US)

(72) Inventors: Brian Grewe, Mableton, GA (US); Brett A. Mitchell, Newnan, GA (US)

(73) Assignee: Kason Industries, Inc., Newnan, GA (US)

( * ) Notice: Subject to any disclaimer, the term of this patent is extended or adjusted under 35 U.S.C. 154(b) by 0 days.

(21) Appl. No.: 16/150,464

(22) Filed: Oct. 3, 2018

(65) Prior Publication Data

US 2019/0106921 A1 Apr. 11, 2019

Related U.S. Application Data

(63) Continuation-in-part of application No. 15/726,301, filed on Oct. 5, 2017, now Pat. No. 10,280,669.

(51) Int. Cl.
*E05F 1/08* (2006.01)
*E05F 1/10* (2006.01)

(52) U.S. Cl.
CPC ..... *E05F 1/1016* (2013.01); *E05Y 2201/216* (2013.01); *E05Y 2201/266* (2013.01); *E05Y 2201/484* (2013.01); *E05Y 2201/492* (2013.01); *E05Y 2201/604* (2013.01); *E05Y 2201/624* (2013.01); *E05Y 2201/638* (2013.01); *E05Y 2600/46* (2013.01); *E05Y 2600/51* (2013.01); *E05Y 2800/28* (2013.01); *E05Y 2900/102* (2013.01)

(58) Field of Classification Search
CPC ..... Y10T 16/625; Y10T 16/593; Y10T 16/56; Y10T 16/304; Y10T 16/2771; Y10T 16/283; Y10T 16/585; E05F 1/1016; E05F 1/1215; E05F 1/14; E05Y 2900/102; E05Y 2900/132; E05Y 2201/484
See application file for complete search history.

(56) References Cited

U.S. PATENT DOCUMENTS 329,032 A * 10/1885 Falls ..... E05F 1/1066 16/80
754,690 A * 3/1904 Perlzer ..... E05F 3/20 16/50

(Continued)

FOREIGN PATENT DOCUMENTS

JP 09151663 A * 6/1997

*Primary Examiner* — Chuck Y Mah
(74) *Attorney, Agent, or Firm* — Baker Donelson

(57) ABSTRACT

A door closer (10) includes an exterior housing (11), a spring assembly (12), a ratchet assembly (13), and a clutch assembly (14). The housing has a central tube (17), drive collar (23), a top end cap (52), and a bottom end cap (65). The drive collar includes an indexing pin channel (41) and indexing pin (42) which includes a pawl (45) having a contact surface (47) and a curved bearing surface (48). The spring assembly includes a shaft (73), a spring stop (80), and a helical torsion spring (106) positioned upon the shaft. The ratchet assembly resides within drive collar and includes ratchet wheel (111) having an annular array of ratchet teeth (112) configured to mesh with the pawl of the indexing pin. Each tooth has an undercut contact surface (113) and a curved bearing surface (114). The clutch assembly includes a bottom disc (120) and a top disc (121).

19 Claims, 4 Drawing Sheets

(56) References Cited

U.S. PATENT DOCUMENTS 926,520 A * 6/1909 Thornton et al. ..... E05F 3/20 16/49
1,912,289 A * 5/1933 March ..... E05F 1/1215 16/279
2,102,321 A * 12/1937 Keene ..... E05F 1/1016 16/76
2,634,454 A * 4/1953 Altenburger ..... E05F 1/1016 16/70
2,651,074 A * 9/1953 Slopa ..... E05F 1/1016 16/80
2,946,081 A * 7/1960 Juergens ..... E05F 1/1016 16/80
3,380,109 A * 4/1968 Ruiz ..... E05F 3/16 16/50
4,073,038 A * 2/1978 Curry ..... E05F 1/1215 16/301
5,333,355 A * 8/1994 Beswick ..... E05F 1/123 16/300
5,495,639 A * 3/1996 Wartian ..... E05F 1/1016 16/79
7,111,358 B1 * 9/2006 Jackson ..... E05F 1/1215 16/50
7,210,199 B2 * 5/2007 Clark ..... E05D 5/06 16/299
8,549,707 B2 * 10/2013 Macernis ..... E05F 1/1215 16/298
8,567,011 B2 * 10/2013 Talpe ..... E05F 5/00 16/54
9,009,916 B2 * 4/2015 Nagl ..... E05F 3/20 16/256
9,206,636 B2 * 12/2015 Nagl ..... E05F 1/1215
9,617,772 B1 * 4/2017 Chen ..... E05F 3/20
9,803,408 B2 * 10/2017 Timothy ..... E05F 1/1207
9,974,398 B2 * 5/2018 Simon ..... E05F 1/1215

* cited by examiner

DOOR CLOSER

REFERENCE TO RELATED APPLICATION

This is a continuation-in-part of U.S. patent application Ser. No. 15/726,301 filed Oct. 5, 2017 and entitled "DOOR CLOSER".

TECHNICAL FIELD

This invention relates generally to door closers, and more particularly to door closers used for commercial refrigerator and freezer doors.

BACKGROUND OF INVENTION

Walk-in cold rooms, such as walk-in coolers, freezers, or other refrigerated environments, are common in various industries, including supermarkets and grocery stores, commercial kitchens, and other food service facilities. These cold rooms typically have one or more access doors for entry and exit.

A problem associated with these types of doors is that their size and thicknesses cause them to be quite heavy. As such, these doors may include a door closer to aid in returning an open door to its fully closed position. These door closers include a spring to actuate the door closing movement. The tension in the spring may be adjusted to vary to closing strength of the door closer depending upon the weight of the door. These door closers also insure that the door is kept in a closed position to maintain a cool environment within the cooler.

A problem with today's door closers is the adjustment feature of the spring tension. Typically, the door closer includes a spring coupled at one end to a rotating torque arm. The torque arm is incrementally rotated to index the torque arm, with each indexing increasing the tension of the spring in one direction and decreasing the tension in the spring in the opposite direction. However, an installer may over index or over tension the spring causing the spring to break either upon indexing the torque arm or initially opening the door wherein the spring is placed under additional tension. Another problem with current door closers is that in order to adjust the tension of a spring, the installer may manually move the rod extending from the torque arm and pushing upon the door while simultaneously moving a catch to lock the position of the spring. This adjustment method is time consuming, tedious, and potentially dangerous as the spring may abruptly move the door closer arm should the tension upon the rod be accidentally released.

Accordingly, there is a need in the art for a door closer that will allow for different door closing tension upon the door to insure proper closing and sealing of the door against the door jamb. It is to the provision of such therefore that the present invention is primarily directed.

SUMMARY OF THE INVENTION

In a preferred form of the invention a door closer for use with a refrigerator door coupled to a door jamb comprises a tubular housing, a mount coupling the housing to the door jamb, a spring shaft rotatably mounted to the housing, a torque arm coupled to the shaft and rotatably coupled to the housing, a clutch assembly coupling the spring shaft to the housing, and a spring mounted about the spring shaft. The spring has a first end coupled to the torque arm and a second end coupled to the clutch assembly. The clutch assembly including a first clutch disc and a second clutch disc rotationally and releasably engaging the first clutch disc. With this construction, the rotational movement of the spring shaft is limited by the engagement of the clutch assembly to prevent over tensioning of the spring.

DETAILED DESCRIPTION

Figure 1:
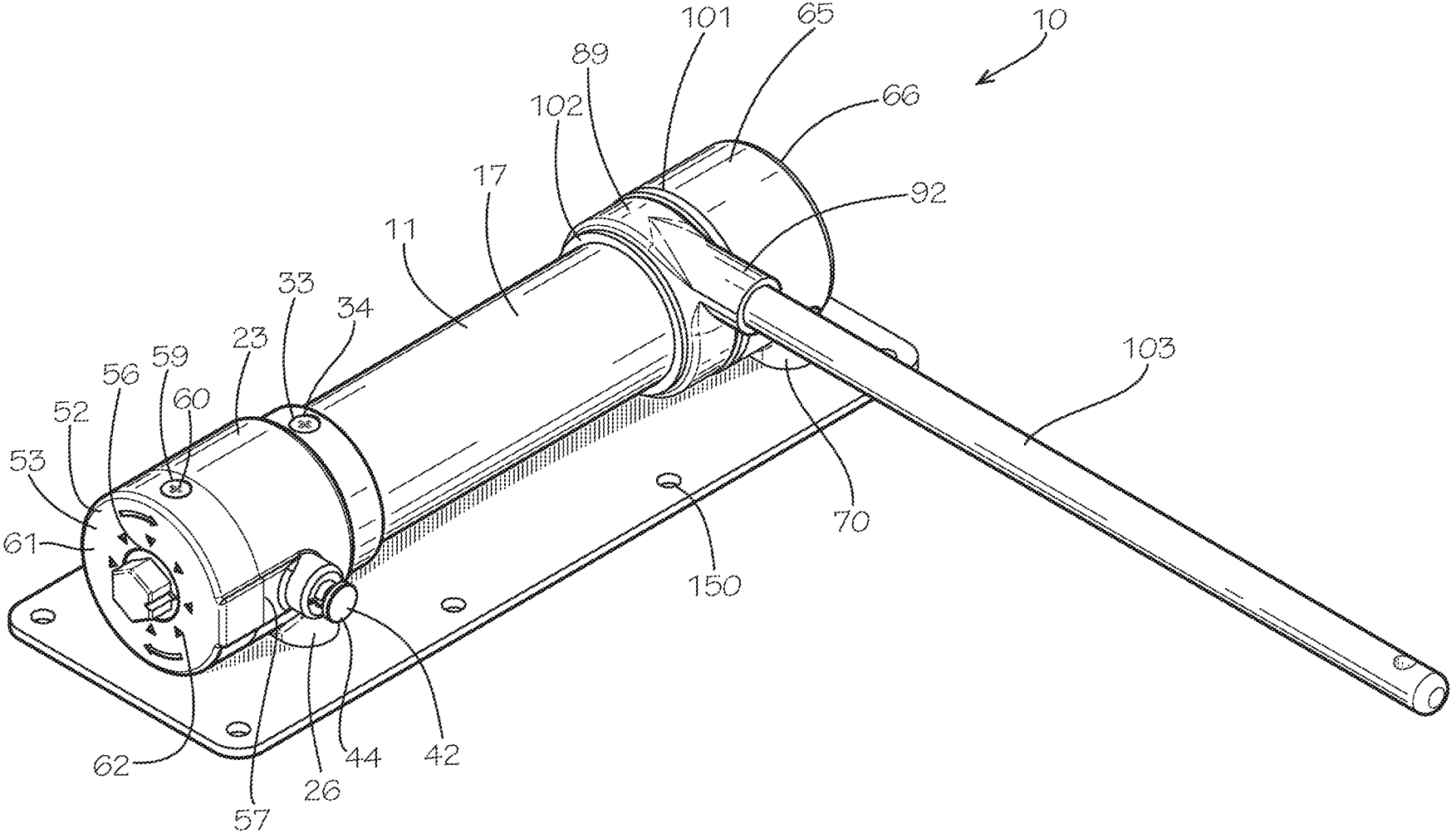
FIG. 1 is a perspective view of a door closer embodying principles of the invention in a preferred form.
Figure 2:
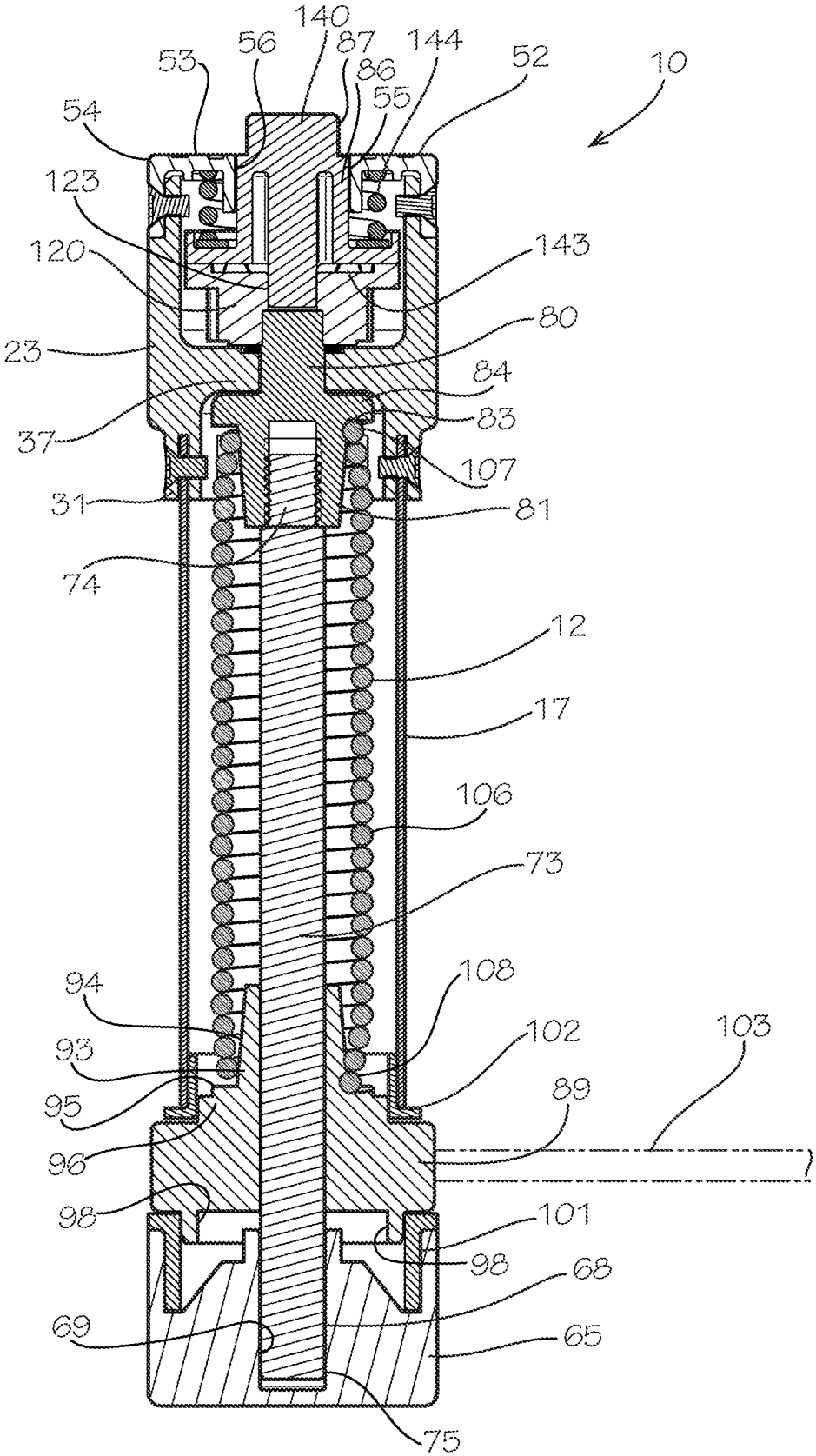
FIG. 2 is a cross-sectional side view of the door closer of FIG. 1.
Figure 3:
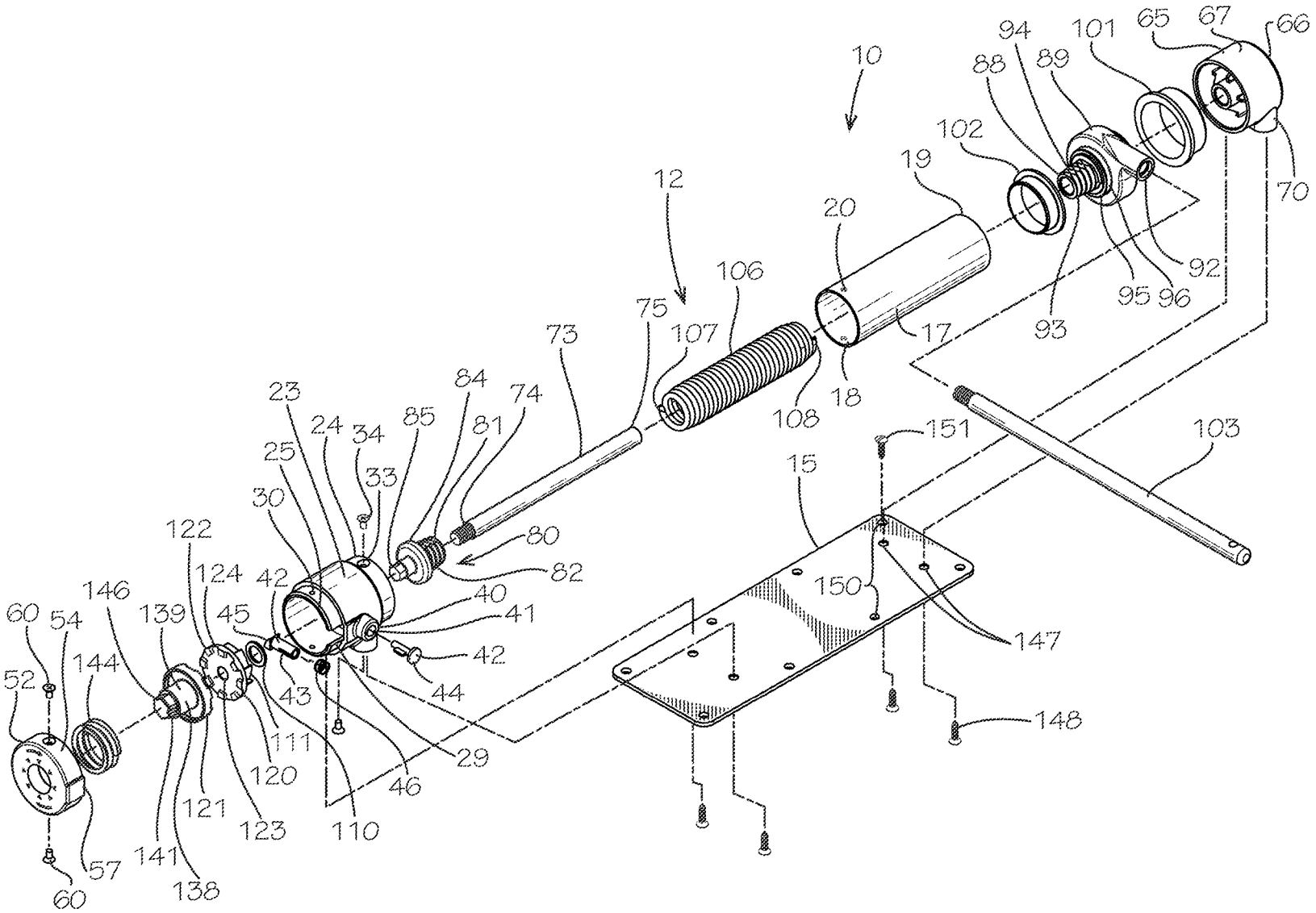
FIG. 3 is an exploded, perspective view of the door closer of FIG. 1.

With reference next to the drawings, there is shown a door closer 10 according to the present invention. It is to be appreciated that the door closer 10 shown in the drawings is configured for use with a walk-in refrigerator or freezer door. The jamb and doors are well-known in the art and need not be disclosed further herein.

The door closer 10 includes a metallic exterior housing 11, an interior spring assembly 12 positioned within the exterior housing 11, a ratchet assembly 13 coupled to the interior spring assembly 12, and a clutch assembly 14 coupled to the ratchet assembly 13. The exterior housing 11 is coupled to a mounting plate 15.

The exterior housing 11 includes a cylindrical, central tube 17 having a top end 18 and a bottom end 19. The central tube 17 has two oppositely disposed screw mounting holes 20 positioned adjacent the top end 18. A drive collar 23 is telescopically coupled to the top end 18 of the tube 17.

The drive collar 23 has an annular tube mounting flange 24, an annular cap mounting flange 25 positioned oppositely from the tube mounting flange 24, and a mounting flange, seat, or leg 26 having a bottom surface with two unshown internally threaded mounting holes. The cap mounting flange 25 has an alignment groove 29 and a pair of oppositely disposed screw mounting holes 30. The tube mounting flange 24 has an inwardly extending annular tube mounting groove 31 configured to receive the top end 18 of the tube 17. The tube mounting flange 24 has two oppositely disposed screw mounting holes 33 configured to align with the screw mounting holes 20 of the tube 17. Mounting screws 34 are positioned to extend through tube screw mounting holes 20 and threaded into drive collar screw mounting holes 33 to lock the drive collar 23 to the tube 17.

The drive collar 23 also has an interior bearing wall 37 with a centrally aligned bore, hole or opening 38 extending therethrough. The drive collar 23 also includes a stop or indexer in the form of an indexing pin socket 40 having an indexing pin channel 41 therethrough. An indexing pin 42 is coupled to the drive collar 23 with an indexing pin shaft 43 journalled or extending through the indexing pin channel 41 for reciprocal movement therein. The indexing pin 42 has a head 44 positioned to abut the socket 40 to limit inward movement of the indexing pin 42, a pawl 45 mounted to the indexing pin shaft 43 opposite head 44, and an indexing pin spring 46 positioned about the pin shaft 43 between the pawl 45 and the drive collar 23 so as to spring bias the indexing pin 42 in an inwardly direction. The pawl 45 is shaped so as to have a generally flat contact surface 47 aligned along the direction of travel of the indexing pin, and a curved bearing surface 48 extending outwardly from the inner-most edge 49 of the contact surface 47.

An annular top cap 52 is telescopically mounted to the cap mounting flange 25 of the drive collar 23. The top cap 52 has an end wall 53, an outer or exterior flange wall 54, and an interior flange wall 55 defining a central opening 56 extending through the end wall 53. The exterior flange wall 54 includes a tongue 57 configured to be received within drive collar groove 29 for alignment purposes and to restrict relative rotation of the top cap 52 upon the drive collar 23. The exterior flange wall 54 includes two screw mounting holes 59 which are positioned to align with the screw mounting holes 30 in the cap mounting flange 25 of the drive collar 23, wherein mounting screws 60 pass through screw mounting holes 59 and are threaded into screw mounting holes 30. The exterior surface 61 of the end wall 53 includes markings 62 about the central opening 56 to indicate a relative position and direction of rotation for tightening the spring.

The exterior housing 11 also includes a bottom end cap 65 having an end wall 66, an outer or exterior flange wall 67, and an interior flange wall or boss 68 defining a central opening 69 extending into the end wall 66. The bottom end cap 65 also includes a mounting flange, seat, or leg 70 having a bottom surface with two unshown internally threaded mounting holes. The bottom end cap 65 is coupled to the tube 17 through a portion of the interior spring assembly 12 discussed in more detailed hereinafter.

The interior spring assembly 12 includes an elongated shaft 73 having a threaded top end 74 and a bottom end 75 having an annular groove therein. A spring stop 80 is threadably coupled to the top end 74 of the shaft 73. The spring stop 80 has a boss 81 with an exterior helical groove 82 terminating at a stop wall or ledge 83 within a shoulder 84 extending from the boss 81. The spring stop 80 also has a spindle 85 with a cylindrical portion 86 extending to a hexagonal portion 87. The cylindrical portion 86 is journalled through the central opening 38 in the interior bearing wall 37 of the drive collar 23 for relative rotation therein.

The bottom portion of the shaft 73 adjacent the bottom end 75 is fixedly mounted by press fitting the shaft into a central channel 88 of a torque arm 89 to prevent relative rotation therebetween. The bottom portion of the shaft extends past the torque arm 89 and is rotatably received within the boss 68 of the bottom end cap 65.

The torque arm 89 also includes an internally threaded socket 92 and a boss 93, which partially defines central channel 88, with an exterior helical groove 94 terminating at a stop wall or ledge 95 within a shoulder 96 extending from the boss 93. An annular flange 98 extends downwardly and is configured to be telescopically received within the exterior flange wall 67 of the bottom end cap 65. An annular, plastic bushing 101 is positioned between the torque arm 89 and the bottom end cap 65 to provide smooth rotational movement therebetween. Similarly, an annular, plastic bushing 102 is positioned between the torque arm 89 and the bottom end 19 of the tube 17 to provide smooth rotation movement therebetween. A door pushing rod 103 is threadably received into threaded socket 92.

A metallic, helical torsion spring 106 is positioned upon the shaft 73 between the spring stop 80 and the torque arm 89. The torsion spring 106 has a top portion or end 107 which nests within the helical groove 82 of boss 81 so that the top end 107 of the spring abuts the stop wall 83 of the spring stop 80. The torsion spring 106 also has a bottom end or portion 108 which nests within the helical groove 94 of boss 93 so that a bottom end 108 of the spring abuts the stop wall 95 of the torque arm 89. With the spring ends 107 and 108 abutting stop walls 83 and 95, any rotation of either the spring stop 80 or the torque arm 89 exerts a rotational force on one end of the torsion spring 106, thereby increasing or decreasing the biasing force of the spring depending upon the direction of rotation, i.e., further coiling or uncoiling the torsion spring.

The ratchet assembly 13 is mounted to the hexagonal portion 87 of the spring stop 80 and is positioned to reside within drive collar 23. The ratchet assembly 13 includes a ratchet or ratchet wheel 111 having an annular array of ratchet teeth 112 and a thrust washer or bearing 110 positioned between the ratchet wheel 111 and the drive collar 23. The ratchet teeth 112 are configured to mesh or work in conjunction with the pawl 45 of the indexing pin 42. Each tooth 112 has an undercut contact surface 113 and an arcuate or curved bearing surface 114 which merge along a top edge 115. The ratchet wheel 111 also includes a central hexagonal socket or opening 116 which receives the hexagonal portion 87 of the spring stop 80 for simultaneous rotational movement therebetween.

The ratchet wheel 111 is mounted, formed with, or otherwise coupled to the clutch assembly 14. Specifically, the clutch assembly 14 includes a first or bottom disc portion or disc 120 and a second or top disc portion or disc 121 configured to releasably mesh with the bottom disc 120. The bottom disc 120 is coaxially aligned with the ratchet wheel 111 and includes a round channel 123 therethrough which is coaxially aligned with the hexagonal opening 116 of the ratchet wheel 111. The top disc 121 also includes an annular or radial array of teeth, projections, ridges, detents 122 positioned about the round channel 123 so as to define a groove, space, or detent 124 between each pair of adjacent teeth 122. The bottom disc 120 also includes an annular or radial array of teeth, projections, ridges, detents 127 so as to define a groove, space, or detent 128 between each pair of adjacent teeth 127.

Each tooth 122 of the top disc 121 has an incline bearing surface or ramp 130, a decline bearing surface or ramp 131, and a flat plateau surface 132 between the incline surface 130 and the decline surface 131. Similarly, each tooth 127 of the bottom disc 120 has an incline bearing surface or ramp 134, a decline bearing surface or ramp 135, and a flat plateau surface 136 between the incline surface 134 and the decline surface 135.

The top disc 121 is coaxially aligned with the bottom disc 120 and retained in position through a central rod, axle, or stem which is configured to be rotationally received within round channel 123 of the bottom disc 120. The top disc 121 also includes an axle or spindle 138 having a round portion 139 extending to a hexagonal drive portion 146, which are both axially and longitudinally aligned along the spring shaft 73. The drive portion 146 extends outwardly from the housing top cap 52 for unencumbered access thereto by an installer. The axle round portion 139 includes a mark 141 which is designed to coordinate with markings 62 on the top cap end wall 53. The round portion 139 of the axle 138 is journalled through the round opening 56 in the end wall 53 of the top cap 52. A helical clutch spring 144 is coupled about the round portion 139 of the axle 138 in abutment with the top cap 52 to spring bias the top disc 121 toward the bottom disc 120.

The mounting plate 15 has screw mounting holes 147 extending therethrough. Mounting screws 148 are passed through screw mounting holes 147 and are threadably received into screw mounting holes withing mounting leg 26 and screw mounting holes of mounting leg 70. The mounting plate 15 also has screw mounting holes 150 which receive mounting screws 151 that pass through mounting holes 150 and are threaded into the door jamb adjacent the door to mount the door closer 10 to the jamb.

In use, the door closer 10 is mounted to a door jamb by passing threaded mounting screws 151 through mounting plate screw mounting holes 150 and into the door jamb. The door push rod 103 is placed against the door. The door may include a conventional push rod receiver adapted to be mounted to the door and slidably couple to the push rod to provide a better sliding action of the push rod against the door.

Once the door closer 10 is mounted to the door jamb, the tension of the torsion spring 106 should be adjusted to provide the door closer 10 with the proper amount of biasing force upon the door. To increase the spring tension or force, a conventional wrench or other tool is coupled to the hexagonal drive portion 146 of axle 139. A clockwise rotation of the hexagonal drive portion 146 causes the top disc 121 to rotate clockwise, which in turn causes the bottom disc 120 meshed with the top disc 121 to rotate clockwise as long as there is not an over-tensioning of the spring 106, as discussed in more detail hereinafter. The clockwise rotation of the top disc 121 causes the same clockwise rotation of the ratchet wheel 111 coupled to the bottom disc 120.

As the ratchet wheel 111 rotates clockwise the indexing pin pawl 45 indexes or stops with one increment with each successive tooth 112 of the ratchet wheel 111 to prevent the spring biased opposite rotation of the ratchet wheel 111. In doing so, the arcuate or curved bearing surface 48 of the pawl 45 rides upon the arcuate or curved bearing surface 114 of each tooth. The curved surface to curved surface contact of the bearing surfaces 48 and 114 provides for a smoother actuation or interaction of the pawl and ratchet wheel. The interaction between these bearing surfaces 48 and 114 continues with the tooth until the pawl falls off the top edge 115 of each tooth. Once the tensioning force upon the ratchet assembly 13 is released, the biasing force of the spring 106 moves the ratchet assembly in the counterclockwise direction. This counterclockwise movement causes the pawl contact surface 47 to engage the ratchet tooth contact surface 113 thereby preventing further counterclockwise rotation. Thus, the ratchet assembly allows for incrementally increasing the torsion of the spring 106 without the need to external devices or manual manipulation of a catch.

Should the installer believe that the door closer's spring tension should be decreased, the installer simply places a slight clockwise rotating force upon the hexagonal portion 146 while simultaneously pulling the indexing pin 42 outwardly so as to disengage the pawl 45 from the teeth 112 of the ratchet wheel 111. With the pawl 45 disengaged, the installer may simply back off or slowly move the wrench upon the hexagonal drive portion 146 counterclockwise the appropriate number of indexes or teeth and then release the indexing pin 42 so that it may re-engage the ratchet wheel 111 in the new position.

Should the installer attempt to tighten the spring tension past an allowable tension, the clutch assembly 14 prevents the spring 106 from being overly tightened. During normal and appropriate clockwise tensioning rotation of the hexagonal portion 146 the top disc 121 remains meshed with bottom disc 120 for simultaneous movement, i.e., the teeth of the top and bottom disc remain meshed. However, once the spring 106 has reached a select or predetermined tension, the continued rotation upon the hexagonal portion 146 causes the clutch assembly 14 to release, thereby temporarily disengaging the top disc 121 from the bottom disc 120.

Figure 6:
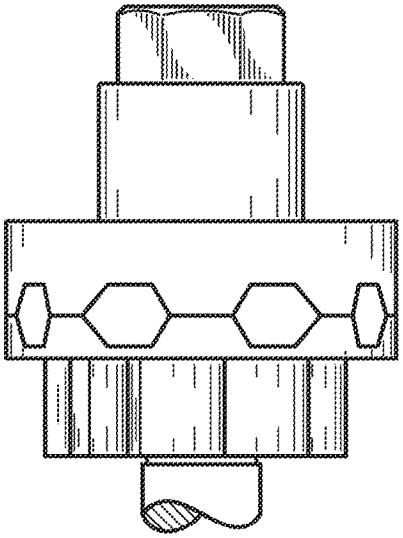
FIGS. 4-6 are a series of side views of the clutch assembly portion of the door closer of FIG. 1.
Figure 5:
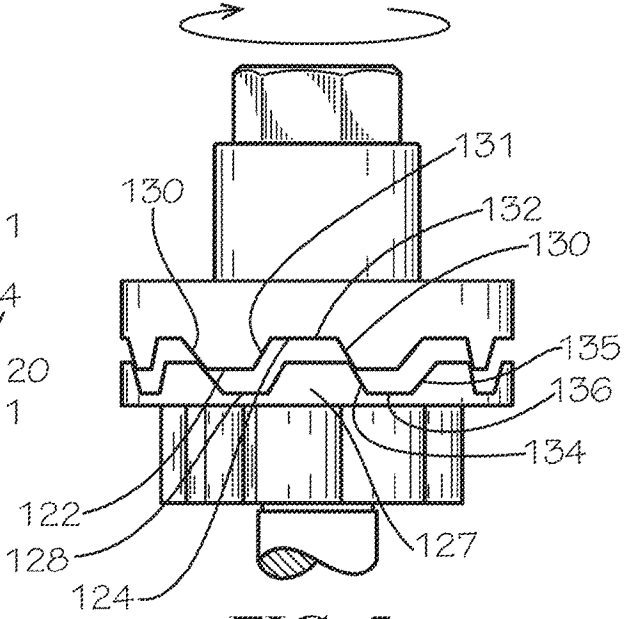
Figure 7:
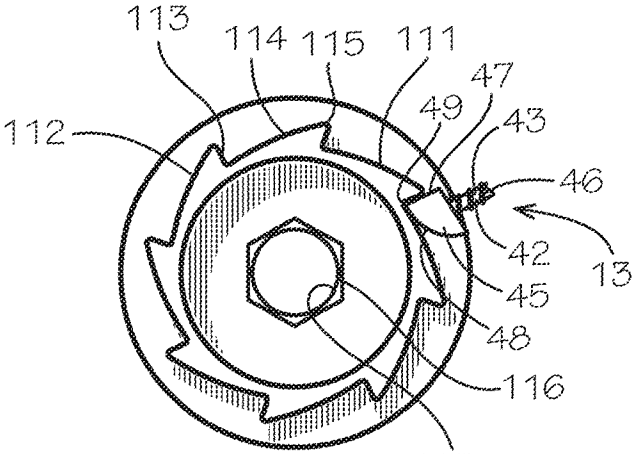
FIG. 7 is a top view of the ratchet assembly portion of the door closer of FIG. 1.
Figure 4:
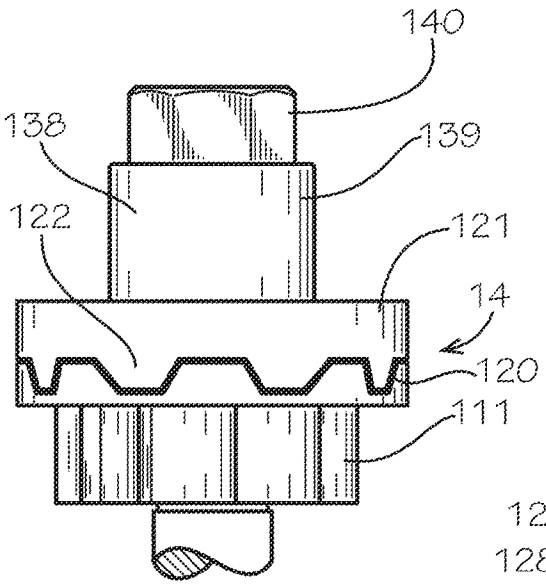

The over tensioning movement upon the hexagonal portion 146 causes the teeth 122 of the top disc 121 to start riding up the teeth 127 of the bottom disc 120, specifically, the incline bearing surface 130 of the top disc teeth 122 starts riding up the incline bearing surface 134 of the bottom disc teeth 127, as shown in FIG. 5. With continued rotation the incline bearing surfaces 130 and 134 move past each, causing the flat bearing surfaces 132 of the top disc teeth 122 to ride upon the flat bearing surfaces 136 of the bottom disc teeth 127, as shown in FIG. 6. The teeth then continue their respective relative movements until the decline bearing surface 131 of the top disc teeth 122 rides down the decline bearing surface 135 of the bottom disc teeth 127 until the top disc teeth and bottom disc teeth are once again meshed, as shown in FIG. 4. As such, each tooth 122 and 127 resides in the opposite disc's space 124 and 128 under normal conditions and becomes displaced from such under over tensioning conditions to release a small incremental amount of the tension and prevent over tightening of the spring 106. It should be understood that the clutch spring 144 pushes downwardly upon the top disc 121 to insure that the top disc quickly re-meshes with or re-engages the bottom disc when slippage between the discs occurs due to over tightening.

An installer may determine how many indexes the installer has moved the ratchet wheel by counting or determining the movement of the axle mark 141 relative to markings 62 on the top cap. The clutch assembly 14 allows an installer to adjust the closing tension of the door closer 10 without over tightening the spring 106 to the point of breaking.

With the door closer 10 properly mounted and the spring tension adjusted, the manual movement of the door from a closed position to an open position causes the door to push upon the door rod 103. The opening force upon the door rod 103 causes the torque arm 89 to rotate relative to the housing tube 17, spring stop 80, bottom end cap 65 and other internal components. This relative rotation of the torque arm 89 causes further tightening, coiling, loading or compression of the torsion spring 106. Upon the manual release of the door, the load or tension within the torsion spring 106 causes the door to be forced back from its open position to its closed position, i.e., the door closer 10 closes the door through the actuation of the spring 106 upon the torque arm 89 and rod 103.

Should the spring be overly tensioned, the additional tension force occurring with the opening of the door causes the same indexing slip or release of the meshing engagement between the top disc 121 and the bottom disc 120 of the clutch assembly, thereby preventing a critical over tensioning of the spring with the opening of the door.

It should be understood that the clutch assembly could to utilized with the door closer without the use of the ratchet assembly, to prevent over tensioning of the spring.

It thus is seen that a new door closer provides for the incremental adjustment of the tension without having to manually manipulate the arm pushing upon the door or manually actuating a catch to lock the positioning of the tightening mechanism.

While this invention has been described in detail with particular reference to the preferred embodiment thereof and the best mode of practicing same, it will be understood that variations and modifications can be effected within the spirit and scope of the invention as described herein above and as set forth in the appended claims.

The invention claimed is:

1. A door closer for use with a refrigerator door coupled to a door jamb, the door closer comprising, a tubular housing;

a mount coupling said housing to the door jamb;

a spring shaft rotatably mounted to said housing;

a torque arm coupled to said shaft and rotatably coupled to said housing;

a clutch assembly coupling said spring shaft to said housing, said clutch assembly including a first clutch disc and a second clutch disc rotationally and releasably engaging said first clutch disc, said first clutch disc and said second clutch disc being mounted within said housing for relative rotational movement therein, and wherein said second clutch disc is rotationally fixed to said spring shaft, and a spring mounted about said spring shaft, said spring having a first end coupled to said torque arm and a second end coupled to said clutch assembly, whereby rotational movement of the spring shaft is limited by the engagement of the clutch assembly to allow select slippage between the first clutch disc and the second clutch disc to prevent over tensioning of the spring.

2. The door closer of claim 1 wherein said first clutch disc includes a first radial array of projections, and wherein said second clutch disc includes a second radial array of projections configured to releasably mesh with said first radial array of projections of said first clutch disc.

3. The door closer of claim 2 wherein each said projection of said first radial array of projections includes an inclining bearing surface, a declining surface, and a flat bearing surface between said inclining bearing surface and said declining bearing surface, and wherein each said projection of said second radial array of projections includes an inclining bearing surface, a declining surface, and a flat bearing surface between said inclining bearing surface and said declining bearing surface.

4. The door closer of claim 1 wherein said first clutch disc is biased against said second clutch disc by a clutch spring.

5. The door closer of claim 2 wherein said first clutch disc is biased against said second clutch disc by a clutch spring.

6. The door closer of claim 1 wherein said first clutch disc includes a drive axle extending outwardly from said tubular housing, and wherein said second clutch disc is coupled to said spring shaft.

7. The door closer of claim 1 further comprising a ratchet assembly coupled to said clutch assembly, said ratchet assembly including a ratchet wheel having a plurality of ratchet teeth, a pawl configured to releasably mate with said ratchet teeth, and a drive portion coupled to said ratchet wheel and axially aligned with said spring shaft, said pawl allowing indexed movement of said ratchet wheel.

8. A door closer for use with a refrigerator door coupled to a door jamb, the door closer comprising, an exterior housing adapted to be mounted to a door jamb;

a spring assembly mounted within said exterior housing, said spring assembly including a shaft rotatably coupled to said exterior housing, a helical spring coupled to said shaft, and a torque arm coupled to said helical spring for rotational movement relative to said exterior housing; and a clutch assembly coupled said shaft of said spring assembly and rotatable relative to said exterior housing, said clutch assembly including a first clutch disc and a second clutch disc releasably engaging said first clutch disc upon reaching a select pressure, and wherein said first clutch disc is biased against said second clutch disc by a clutch spring, whereby the clutch assembly releases should the helical spring be overly tensioned by allowing slippage between said first clutch disc and said second clutch disc.

9. The door closer of claim 8 wherein said first clutch disc includes a first radial array of projections, and wherein said second clutch disc includes a second radial array of projections configured to releasably mesh with said first radial array of projections of said first clutch disc.

10. The door closer of claim 9 wherein each said projection of said first radial array of projections includes an inclining bearing surface, a declining surface, and a flat bearing surface between said inclining bearing surface and said declining bearing surface, and wherein each said projection of said second radial array of projections includes an inclining bearing surface, a declining surface, and a flat bearing surface between said inclining bearing surface and said declining bearing surface.

11. A door closer for use with a refrigerator door coupled to a door jamb, the door closer comprising, an exterior housing adapted to be mounted to a door jamb;

a spring assembly mounted within said exterior housing, said spring assembly including a shaft rotatably coupled to said exterior housing, a helical spring coupled to said shaft, and a torque arm coupled to said helical spring for rotational movement relative to said exterior housing; and a clutch assembly coupled said shaft of said spring assembly and rotatable relative to said exterior housing, said clutch assembly including a first clutch disc and a second clutch disc releasably engaging said first clutch disc upon reaching a select pressure, wherein said first clutch disc includes a drive axle extending outwardly from said tubular housing, and wherein said second clutch disc is coupled to said shaft of said spring assembly.

12. A door closer for use with a refrigerator door coupled to a door jamb, the door closer comprising, an exterior housing adapted to be mounted to a door jamb;

a spring assembly mounted within said exterior housing, said spring assembly including a shaft rotatably coupled to said exterior housing, a helical spring coupled to said shaft, and a torque arm coupled to said helical spring for rotational movement relative to said exterior housing;

a clutch assembly coupled said shaft of said spring assembly and rotatable relative to said exterior housing, said clutch assembly including a first clutch disc and a second clutch disc releasably engaging said first clutch disc upon reaching a select pressure, and a ratchet assembly coupled to said clutch assembly, said ratchet assembly including a ratchet wheel having a plurality of ratchet teeth, a pawl configured to releasably mate with said ratchet teeth, and a drive portion coupled to said ratchet wheel and axially aligned with said shaft of said spring assembly, said pawl allowing indexed movement of said ratchet wheel.

13. A door closer for use with a refrigerator door coupled to a door jamb, the door closer comprising, a first end cap;

a torque arm rotatably coupled to said first end cap;

a housing tube rotatably coupled to said torque arm;

a drive collar fixedly coupled to said housing tube oppositely disposed from said torque arm;

a spring shaft having a first end fixedly mounted to said torque arm and rotatably mounted to said first end cap, and a second end fixedly coupled to a spring stop;

a clutch coupled to said spring shaft through said spring stop;

a second end cap fixedly mounted to said drive collar, and a torsion spring mounted about said spring shaft, said torsion spring having a first end coupled to said torque arm and a second end coupled to said spring stop, whereby rotational movement of the torque arm causes rotational movement of the spring shaft and said first end of said torsion spring thereby causing an increased tension upon the spring and an increase in spring tension upon the torque arm wherein the spring tension upon the torque arm being limited by the release of the clutch.

14. The door closer of claim 13 wherein said clutch includes a first clutch disc with a first radial array of projections, and a second clutch disc with a second radial array of projections configured to releasably mesh with said first radial array of projections of said first clutch disc.

15. The door closer of claim 14 wherein each said projection of said first radial array of projections includes an inclining bearing surface, a declining surface, and a flat bearing surface between said inclining bearing surface and said declining bearing surface, and wherein each said projection of said second radial array of projections includes an inclining bearing surface, a declining surface, and a flat bearing surface between said inclining bearing surface and said declining bearing surface.

16. The door closer of claim 14 wherein said first clutch disc is biased against said second clutch disc by a clutch spring.

17. The door closer of claim 15 wherein said first clutch disc is biased against said second clutch disc by a clutch spring.

18. The door closer of claim 14 wherein said first clutch disc includes a drive axle extending outwardly from said second end cap, and wherein said second clutch disc is coupled to said spring shaft.

19. The door closer of claim 13 further comprising a ratchet assembly coupled to said clutch, said ratchet assembly including a ratchet wheel having a plurality of ratchet teeth, a pawl configured to releasably mate with said ratchet teeth, and a drive portion coupled to said ratchet wheel and axially aligned with said spring shaft, said pawl allowing indexed movement of said ratchet wheel.

* * * * *